United States Patent [19]

Stalder

[11] 4,446,671

[45] May 8, 1984

[54] DEVICE AND METHOD FOR PACKING VARIOUS PRODUCTS IN BOXES

[75] Inventor: Heinz Stalder, Vufflens-La-Ville, Switzerland

[73] Assignee: Sapal, Societe Anonyme des Plieuses Automatiques, Switzerland

[21] Appl. No.: 312,805

[22] Filed: Oct. 19, 1981

[30] Foreign Application Priority Data

Oct. 21, 1980 [CH] Switzerland ..... 7840/80

[51] Int. Cl.[3] ..... B65B 5/08; B65B 35/38

[52] U.S. Cl. ..... 53/445; 53/448; 53/537; 53/539; 53/543; 53/263

[58] Field of Search ..... 53/247, 263, 238, 445, 53/448, 446, 543, 537, 539

[56] References Cited

U.S. PATENT DOCUMENTS 3,694,994 10/1972 Corderoy ..... 53/445 X
4,048,780 9/1977 Chenevard ..... 53/247 X
4,151,698 5/1979 Müller et al. ..... 53/240 X
4,246,740 1/1981 Chenevard ..... 53/247 X

FOREIGN PATENT DOCUMENTS 987167 3/1965 United Kingdom ..... 53/244

*Primary Examiner*—Horace M. Culver
*Attorney, Agent, or Firm*—Lerner, David, Littenberg, Krumholz & Mentlik

[57] ABSTRACT

A device and method for packing chocolates or related products includes a mold with a series of cavities. Product push devices cross the bottoms of the cavities so that the chocolates are pushed out of the mold to later be drawn together and carried into a box. The mold includes slots which receive longitudinal and transverse separating partitions. Product push devices push the partitions out of the slots while the chocolates are pushed out of the mold, so that the partitions remain between the chocolates for placement into a box.

7 Claims, 3 Drawing Figures

DEVICE AND METHOD FOR PACKING VARIOUS PRODUCTS IN BOXES

FIELD OF THE INVENTION

This invention relates to devices for packing various products such as chocolates in boxes and, more particularly, where partitions are to be placed between the several products within the box.

BACKGROUND OF THE INVENTION

In Swiss patent application Ser. No. 7854/78-6, which corresponds to U.S. Pat. No. 4,246,740 in the name of Alexis Chenevard, there is disclosed an apparatus for packing products in boxes. The apparatus includes a mold with cavities intended to initially receive the products to be boxed. The bottom of each cavity is mobile and includes a push device which is adapted to push the product contained within the cavity so that the product is positioned above the mold. Means are disclosed for drawing the products against one another and a suction device transports the products and places them in a box.

In the aforesaid Swiss patent application, the mold consists of a plate having a number of cavities positioned in a regular pattern, with spaces between the various cavities. When the objects, in particular chocolates, are pushed out of the cavities of the mold by the push devices which constitute the mobile bottoms of the cavities, the objects are, at that time, spaced apart to a greater extent than is desired for the ultimate packing of the objects in the box. Accordingly, it is necessary to draw or group the products together. Then, they are finally carried in the grouped or closed configuration by a suction tube for placement within the box.

As is generally known, certain manufacturers of chocolates and other products choose to present their products in boxes which have a number of compartments separated by partitions. These partitions are typically made of smooth or corrugated cardboard strips. The manufacturer may choose to group his chocolates or other products in the various compartments by product categories. For example, one compartment in a box of chocolates may include chocolates with nuts; another may have chocolates with cream filling; and so forth. In some instances, the manufacturer may provide the customer with a "map" of the assortment, with a description of contents of each compartment set forth inside the lid of the box or elsewhere to enable the consumer to recognize the various products in advance and to make his selection easier.

While the arrangement and apparatus described in the aforesaid Swiss patent application is well adapted for the usual boxing of chocolates, it does not take into account the packing of chocolates in boxes which have compartments separated by partitions, and it makes no particular provision for dealing with this contingency. Accordingly, in order to pack chocolates in a box in which the chocolates are separated by compartments, it might be necessary to insert the partitions by hand after the chocolates are packed in the box, or to follow some other procedure, which could result in additional time and labor costs as well as possible damaging or mishandling of the chocolates which are somewhat fragile.

Accordingly, it is an object of the present invention to provide a device and a method for packing products such as chocolates in boxes in which partitions are to be placed between the products.

It is a further object of the present invention to provide such an apparatus and method which allows for the placement of the partitions without undue handling of the products.

It is another object of the present invention to provide such an apparatus and method which achieves the aforegoing objects quickly, efficiently and inexpensively.

Various other objects and advantages of the present invention will become clear from the following detailed description of exemplary emodiments thereof, and the novel features will be particularly pointed out in conjunction with the claims appended hereto.

SUMMARY OF THE INVENTION

In accordance with the teaching of the present invention, apparatus for packaging a plurality of products comprises a mold including a plurality of cavities, said cavities including an upper surface and a base portion for receiving said products, a plurality of product pushing means movable between a first position at said base portion of said plurality of cavities and a second position proximate to said upper surface of said plurality of cavities for elevating said products contained in said plurality of cavities to said second position, said mold including at least one slot formed between a plurality of said cavities and including an upper surface and a base portion for receiving a partition, and at least one partition pushing means movable between a first position at said base portion of said slot and a second position proximate to said upper surface of said slot for elevating a partition contained in said at least one slot to said second position of said slot, whereby said products and said partition are placed in a position where they may be drawn together and transported together in a container. A method of packaging products in boxes comprises the steps of placing products within a plurality of cavities within a mold and placing a partition within at least one slot in said mold situated between a plurality of said cavities; and elevating said products and said partition substantially simultaneously to a position proximate the upper surface of said mold where said products and said slot may be drawn together and transported together into a container.

The invention will be more fully understood by reference to the following detailed description of exemplary embodiments thereof in conjunction with the accompanying drawings in which:

FIG. 1 is a partially cut away perspective view of an apparatus according to the present invention, in which products are located in several of the respective cavities and in which the partition pushing means are withdrawn and where the partitions are located within the slots.

FIG. 2 is a partially cut away perspective view similar to that of FIG. 1, but where the products are pushed out of their cavities and the separating partitions are pushed out of their slots by the partition pushing means; and FIG. 3 is a perspective view representing some of the products drawn together after having been taken out of the cavities of the mold, along with the separating partitions, all of which are ready to be placed in a box.

DESCRIPTION OF THE PREFERRED EMBODIMENT

Figure 1:
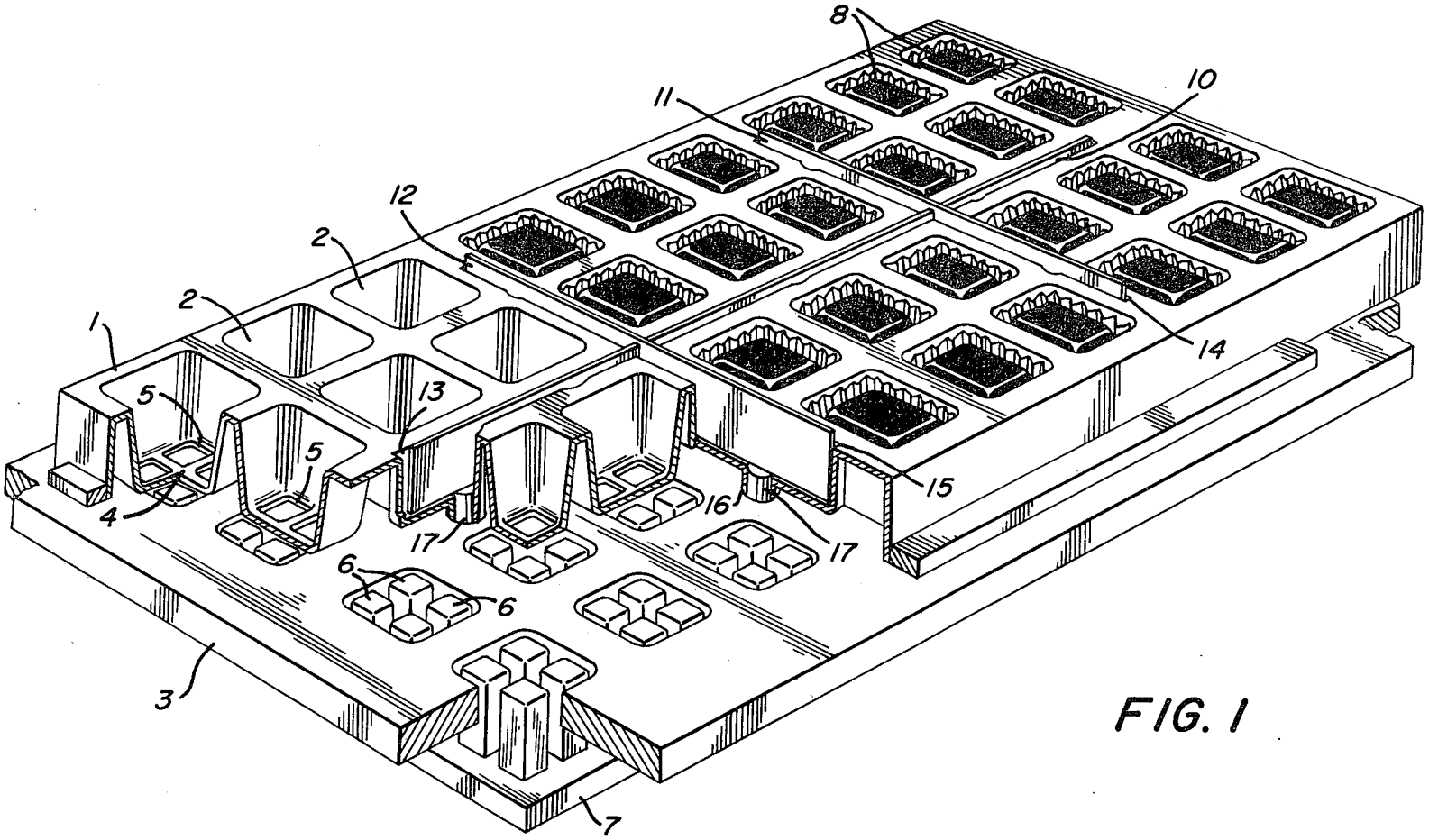
Figure 2:
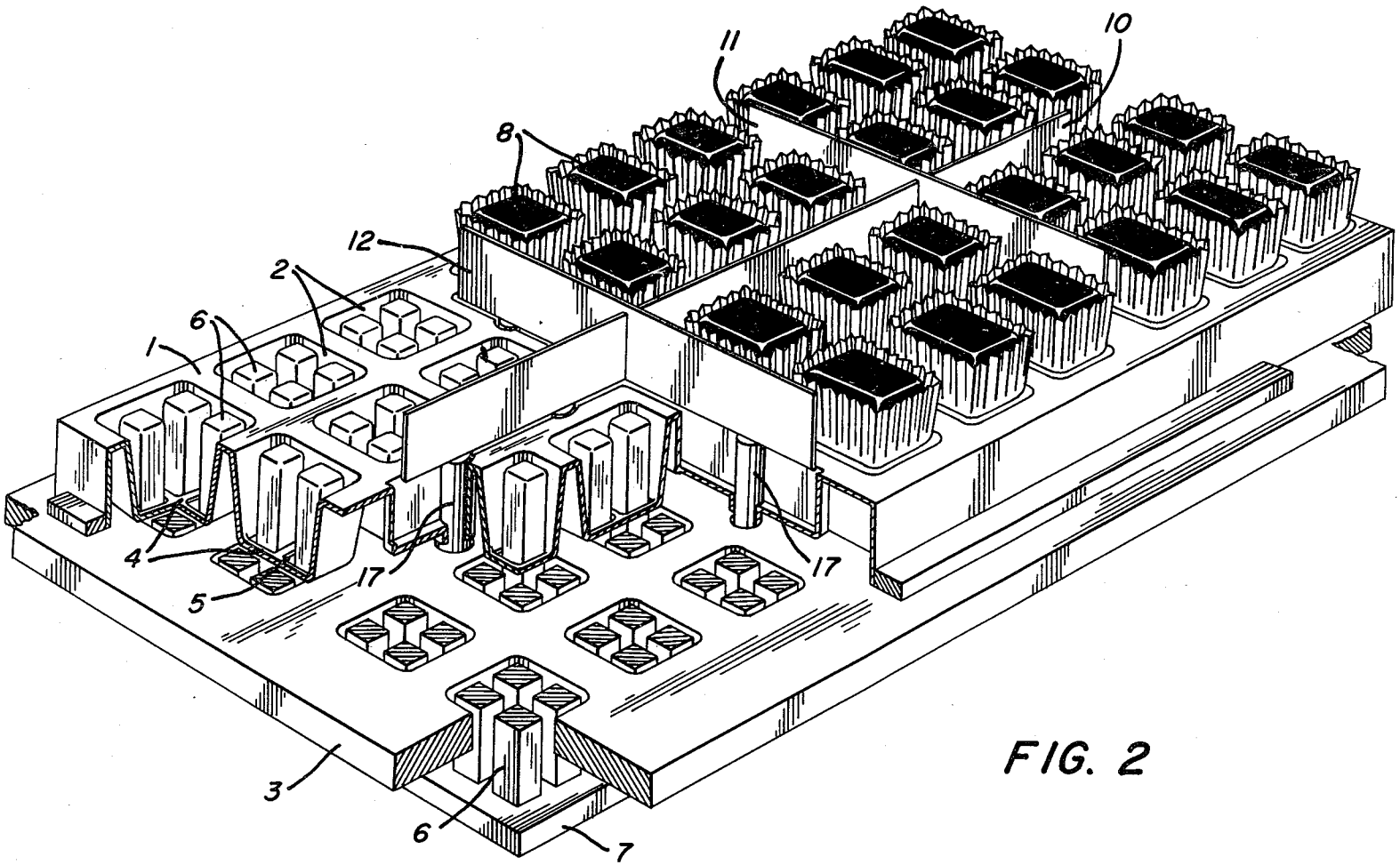

Referring now the drawings, wherein like reference numerals designate like parts throughout the several views and more particularly to FIGS. 1 and 2, there is shown a mold which consists of a generally horizontal plate 1 in which there are formed a number of cavities 2 below the top horizontal surface of the plate 1. The cavities 2 are arranged in a regular pattern and are intended to receive products such as assorted chocolates. The bottom 4 of the cavities 2 can be entirely open but preferably comprise a series of openings 5 as shown in FIGS. 1 and 2. In particular, the bottom 4 of the cavities 2 has four openings 5 arranged in a square pattern, with a cross support piece situated between the openings 5 to support the chocolates 8.

The plate 1 is positioned on a flat base 3 which has openings whose positions coincide with the bottoms 4 of the cavities 2. A plate 7 is positioned below the flat base 3. Product push devices 6, in the form of small columns having square cross sections, are mounted on the plate 7, which in turn is adapted to be positioned in a low position as represented by FIG. 1 and a high position as represented in FIG. 2.

The product push devices 6 are arranged on the plate 7 to pass through the openings in the flat base 3 and then through the openings 5 in the bottoms 4 of the cavities 2. When the plate 7 is in its low position (FIG. 1), the push devices 6 are level with or below the bottom 4 of the cavities 2. When the plate 7 is in its high position (FIG. 2), the push devices are introduced through the openings 5 and into and through the interior of the cavities.

Accordingly, it will be readily appreciated that when the plate 7 is in its low position, the cavities are ready to receive the chocolates 8 (which are placed in paper cups) or any other appropriate objects. When the plate 7 is in its high position, the chocolates 8 within their cups are pushed upward so that they are out of the cavities 2 of the mold 1, as shown in FIG. 2. When the chocolates have thus been elevated, they are vertically displaced from their original positions; however, the horizontal spacing between the chocolates 8 will be essentially the same as existed while the chocolates were within the cavities 2. This spacing is typically somewhat greater than the spacing that is ultimately desired between the chocolates 8. In the elevated position shown in FIG. 2, the chocolates are then drawn or gathered together by appropriate means (not shown) to then be carried by a suction tube or similar device (not shown) into the box.

Figure 3:
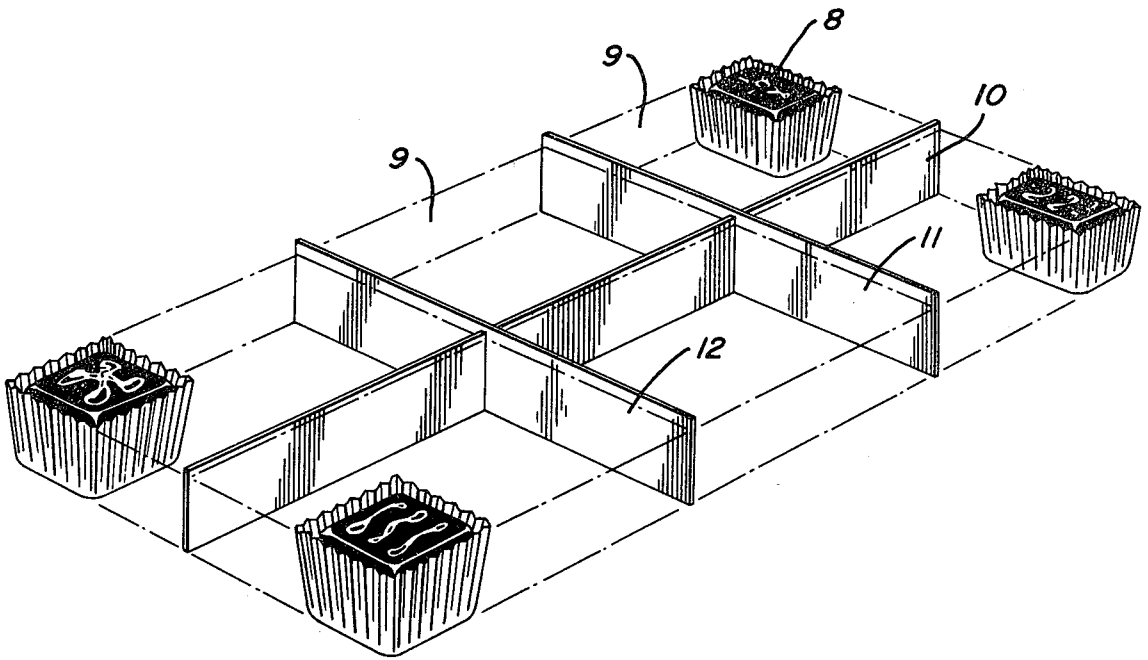

FIG. 3 illustrates a few of the products 8 in their appropriate position to be introduced into a box, which box is represented in phantom in FIG. 3. In the embodiment illustrated in FIG. 3, the chocolates 8 are intended to be placed respectively in six compartments 9 which are demarcated by three separating partitions: a longitudinal partition 10 and two transverse partitions 11 and 12. The partitions 10, 11 and 12 can be made from any appropriate material and may be rigid or flexible plates made of smooth or corrugated cardboard, for example. The partitions themselves will preferably be rigid enough to support their own weight when they are pushed upwardly as described below.

It will readily be appreciated that the number of compartments 9 is not limited to six. Depending upon the requirements and desires of the manufacturer, it is possible to provide for a different number of compartments 9 or to have a different number of partitions. It is possible to add supplementary transverse partitions, or to take away transverse partitions or longitudinal partitions.

In order to position the partitions 11 and 12, the mold includes a longitudinal slot 13 intended to receive the longitudinal partition 10, and two transverse slots 14 and 15 intended to receive transverse partitions 11 and 12 respectively. The slots 13, 14 and 15 are constructed in the plate 1 at locations between various rows or columns of cavities 2, as best illustrated in FIG. 1. It will be understood that, in the embodiment shown in FIGS. 1 and 2, the longitudinal slot 13 intersects each of the transverse slots 14 and 15 at a point near the centers of the transverse slots 14 and 15.

Partition push devices 17 are mounted to the plate 7 in the same manner as the product push devices 6. The partition push devices 17 are positioned on the plate 17 at locations which correspond to the locations of the slots 13, 14 and 15 in the plate 1. There are preferably two partition push devices 17 provided for each slot, and they are positioned near but preferably not precisely at the end of the slots, to prevent canting of the partitions during elevation.

At the bottom of the slots 13, 14 and 15 there are provided openings 17 which are shaped and positioned to allow for the passage of partition push devices 17. The purpose of the partition push devices 17 is to push the separating partitions 13, 14 and 15 up and above the plate 1 at the same time that the product push devices 6 are pushing the chocolates 8 upwardly in a similar manner. This is achieved by having the product push devices 6 and the partition push devices 17 mounted to the same plate 7.

As seen in FIGS. 1 and 2, the partition push devices 17 are cylindrical. They are preferably centered with respect to the appropriate slots, so that a wide portion of the top of the partition push device 17, preferably a full diameter, is available to make contact with the partition.

FIG. 2 illustrates the longitudinal separating partitions 10 and transverse separating partitions 11 and 12 pushed out of the mold 1 by partition push devices 17 as the chocolates 8 are simultaneously pushed out of the mold 1 by the product push devices 6.

In order to draw the chocolates 8 together, the transverse separating partitions 11 and 12 are slightly higher than the longitudinal separating partition 10 and each includes a central cut which allows the transverse partitions 11 and 12 to sit on and slide along the longitudinal partition 10. In the example shown in FIG. 3, as in all other variants where the partitions must be moved with respect to each other during the drawing operation, the sliding partitions must be slightly higher than the fixed partition in order to enable the sliding partition to slide along the fixed partition.

In contrast, when there are only four compartments separated by one transverse partition and one longitudinal partition, the position of both partitions may remain unchanged during the drawing together operation, since it may be possible to only have the products drawn together toward the partitions. Alternatively, when four compartments are to be used, one of the two partitions may be made in two parts, thus eliminating the need for a central cut within a partition and allowing the partitions to be of the same height. Where that is to be done, it will be understood that partition push devices 17 should be positioned so that they provide sufficient support for each partition or segment thereof.

As will be readily apparent to those skilled in the art, the invention may be used in other specific forms of packing apparatus and method without departing from its spirit or essential characteristics. The present embodiments are, therefore, to be considered as illustrative and not restrictive, the scope of the invention being indicated by the claims rather than the foregoing description, and all changes which come within the meaning and range of equivalence of the claims are therefore intended to be embraced therein.

What is claimed is:

1. Apparatus for packaging a plurality of products comprising a mold including a plurality of cavities, said cavities including an upper surface and a base portion for receiving said products, a plurality of product pushing means movable between a first position at said base portion of said plurality of cavities and a second position proximate to said upper surface of said plurality of cavities for elevating said products contained in said plurality of cavities to said second position, said mold including at least one slot formed between a plurality of said cavities and including an upper surface and a base portion for receiving a partition, and at least one partition pushing means movable between a first position at said base portion of said slot and a second position proximate to said upper surface of said slot for elevating a partition contained in said at least one slot to said second position of said slot, wherein said plurality of product pushing means elevate said products and said at least one partition pushing means elevate said partition substantially simultaneously, whereby said products and said partition are substantially simultaneously placed in a position where they may be drawn together and transported together into a container.

2. Apparatus according to claim 1 wherein said first position of said product pushing means substantially corresponds to said first position of said partition pushing means and said second position of said product pushing means substantially corresponds to said second position of said partition pushing means.

3. Apparatus according to claim 1 wherein said at least one slot includes at least one opening in said base constructed and arranged to allow the passage of said partition pushing means therethrough.

4. Apparatus according to claim 3 wherein said plurality of cavities include at least one opening in said base of said cavities constructed and arranged to allow the passage of said product pushing means therethrough and further comprising a plate positioned below said mold, wherein said product pushing means and said partition pushing means are mounted to said plate.

5. Apparatus according to claim 1 or claim 2 or claim 3 or claim 4 wherein said mold includes at least one longitudinal slot and at least one transverse slot.

6. Apparatus according to claim 5 wherein one of said partition pushing means is positioned proximate each end of each slot.

7. A method of packaging products in boxes comprising the steps of placing products within a plurality of cavities within a mold and placing a partition within at least one slot in said mold situated between a plurality of said cavities; and elevating said products and said partition substantially simultaneously to a position proximate the upper surface of said mold where said products and said slot may be drawn together and transported together into a container.

* * * * *